US011348526B2

(12) United States Patent
Zhang

(10) Patent No.: US 11,348,526 B2
(45) Date of Patent: May 31, 2022

(54) PIXEL MIXED COMPENSATION CIRCUIT AND PIXEL MIXED COMPENSATION METHOD

(71) Applicant: Shenzhen China Star Optoelectronics Semiconductor Display Technology Co., Ltd., Shenzhen (CN)

(72) Inventor: Liuqi Zhang, Shenzhen (CN)

(73) Assignee: Shenzhen China Star Optoelectronics Semiconducstor Display Technology Co., Ltd., Shenzhen (CN)

( * ) Notice: Subject to any disclaimer, the term of this patent is extended or adjusted under 35 U.S.C. 154(b) by 195 days.

(21) Appl. No.: 16/641,238

(22) PCT Filed: Dec. 27, 2019

(86) PCT No.: PCT/CN2019/129274
§ 371 (c)(1),
(2) Date: Feb. 23, 2020

(87) PCT Pub. No.: WO2021/120315
PCT Pub. Date: Jun. 24, 2021

(65) Prior Publication Data

US 2021/0390908 A1 Dec. 16, 2021

(30) Foreign Application Priority Data

Dec. 17, 2019 (CN) ..... 201911304678.8

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... G09G 3/3233; G09G 3/3258; G09G 2300/0819; G09G 2300/0828;
(Continued)

(56) References Cited

U.S. PATENT DOCUMENTS

2014/0176401 A1* 6/2014 Kim ..... G09G 3/3208 345/76
2017/0316738 A1* 11/2017 Sohn ..... G09G 3/3233
(Continued)

*Primary Examiner* — Tom V Sheng

(57) ABSTRACT

The disclosure provides a pixel mixed compensation circuit and a pixel mixed compensation method. The pixel mixed compensation circuit includes a plurality of pixel internal driving circuits arranged in an array and an external compensation circuit connecting with each of the internal driving circuits. A fourth TFT and a second capacitor are disposed between a source of a third TFT and a drain of a third TFT. The fourth TFT is turned on only during a detecting stage. The second capacitor is configured to feed back changes in electric potential of a second node to a sensing line. The external compensation circuits can detect changes in electric potential of the second node by the sensing line. The external compensation circuit can directly react to changes in current and can transmit a voltage value to a first node via data signals to adjust a voltage of the first node.

10 Claims, 2 Drawing Sheets

(52) U.S. Cl.
CPC . *G09G 2300/0828* (2013.01); *G09G 2310/08* (2013.01); *G09G 2320/0233* (2013.01); *G09G 2320/0295* (2013.01); *G09G 2320/045* (2013.01)

(58) Field of Classification Search
CPC ..... G09G 2310/08; G09G 2320/0233; G09G 2320/045; G09G 2320/0295
USPC ..... 345/214
See application file for complete search history.

(56) References Cited

U.S. PATENT DOCUMENTS

| | | | | |
|---|---|---|---|---|
| 2018/0096649 | A1* | 4/2018 | Lee | G09G 3/3291 |
| 2018/0174517 | A1* | 6/2018 | Lee | G09G 3/3233 |
| 2018/0182278 | A1* | 6/2018 | Kim | G09G 3/2018 |
| 2018/0308430 | A1* | 10/2018 | Xu | G09G 3/3233 |
| 2020/0051500 | A1* | 2/2020 | Lin | G09G 3/3258 |
| 2020/0118489 | A1* | 4/2020 | Lin | G09G 3/3233 |
| 2020/0127077 | A1* | 4/2020 | Son | H01L 27/1225 |
| 2020/0193918 | A1* | 6/2020 | Hwang | G09G 3/3233 |
| 2020/0202777 | A1* | 6/2020 | Lee | G09G 3/20 |
| 2021/0056899 | A1* | 2/2021 | Bae | G09G 3/3233 |
| 2021/0193034 | A1* | 6/2021 | Li | G09G 3/3233 |
| 2021/0202605 | A1* | 7/2021 | Wu | H01L 27/3265 |
| 2021/0202679 | A1* | 7/2021 | Li | H01L 27/3262 |
| 2021/0225290 | A1* | 7/2021 | Kang | G09G 3/3266 |
| 2021/0335262 | A1* | 10/2021 | Wu | G09G 3/3258 |
| 2022/0036818 | A1* | 2/2022 | Yin | G09G 3/3266 |

* cited by examiner

PIXEL MIXED COMPENSATION CIRCUIT AND PIXEL MIXED COMPENSATION METHOD

RELATED APPLICATIONS

This application is a National Phase of PCT Patent Application No. PCT/CN2019/129274 having International filing date of Dec. 27, 2019, which claims the benefit of priority of Chinese Patent Application No. 201911304678.8 filed on Dec. 17, 2019. The contents of the above applications are all incorporated by reference as if fully set forth herein in their entirety.

FIELD AND BACKGROUND OF THE INVENTION

The present disclosure relates to the field of display technology and, more particularly, relates to a pixel mixed compensation circuit and a pixel mixed compensation method.

Organic light-emitting diode (OLED) is a self-luminous display technology, which has advantages such as wide viewing angles, high contrast, low power consumption, and bright colors. Because of such advantages, a proportion of active matrix organic light-emitting diode (AMOLED) in display industry has increased year after year. Oxide thin film transistors (TFTs) are widely used in large-scale AMOLEDs because of their advantages such as high mobility and good uniformity.

However, when panels are used for long periods of time, electrical drift occurs in TFTs and OLEDs, thereby resulting in failure because of display abnormality.

Consequently, it is necessary to provide a novel pixel mixed compensation circuit and a pixel mixed compensation method to provide compensation voltage for a TFT of a pixel internal driving circuit.

SUMMARY OF THE INVENTION

An objective of the present disclosure is to provide a pixel mixed compensation circuit and a pixel mixed compensation method. A fourth TFT and a second capacitor are disposed between a source of a third TFT and a drain of a third TFT. The fourth TFT is turned on only during a detecting stage, and is turned off during a lighting process to prevent fourth TFTs in different rows from interfering with each other. The second capacitor is configured to feed back changes in electric potential of a second node to a sensing line. An external compensation circuit can detect the changes in electric potential, which are changes in current resulting from drifts of a threshold voltage (Vth) and mobility, of the second node by the sensing line. The external compensation circuit can directly react to changes in current and can transmit a voltage value, which is to be set, to a first node via data signals to adjust a voltage of the first node. Therefore, a Vgs of a first TFT remains unchanged because of a compensation voltage.

To achieve the above goals, the present disclosure provides a pixel mixed compensation circuit, including a plurality of internal driving circuit of pixels arranged in an array and an external compensation circuit connecting with each of the pixel internal driving circuits by a first switch. Each of the pixel internal driving circuits includes a first thin film transistor (TFT), wherein a gate of the first TFT electrically connects with a first node, a source of the first TFT electrically connects with a second node, and a drain of the first TFT receives a power supply voltage (VDD); a second TFT, wherein a gate of the second TFT receives a plurality of writing signals, a source of the second TFT receives a plurality of data signals, and a drain of the second TFT electrically connects the first node; a third TFT, wherein a gate of the third TFT receives the writing signals, a source of the third TFT electrically connects with the first node, and a drain of the third TFT electrically connects with a sensing line; a fourth TFT, wherein the fourth TFT receives a plurality of scan signals, a source of the fourth TFT electrically connects with a second capacitor, and a drain of the fourth TFT electrically connects with the second node; a first capacitor, wherein an end the first capacitor electrically connects with the first node, and another end of the first capacitor electrically connects with the second node; the second capacitor, wherein an end of the second capacitor electrically connects with the sensing line; and an organic light-emitting diode (OLED), wherein an anode of the OLED electrically connects with the second node, and a cathode of the OLED connects with ground. The sensing line electrically connects to a plurality of parasitic capacitances connecting with ground and parallelly connecting with each other, and the sensing line electrically receives a reference voltage (Vref) by a second switch. The external compensation circuit is configured to detect whether standard voltages (Vgs) of the first node and the second node are equal to the VDD, if not, the external compensation circuit calibrates the data signals transmitted into a pixel circuit according to a difference between the Vgs and the VDD, and then transmits calibrated data signals into the pixel circuit.

Furthermore, the external compensation circuit includes an analog-to-digital converter, wherein an input end of the analog-to-digital converter electrically correspondingly connects with the sensing line in each of the pixel internal driving circuits; a voltage comparator, wherein an output end of the voltage comparator electrically connects with an input end of a control module; the control module, wherein an output end of the control module electrically connects to an input end of a memory; the memory, wherein an input end of the memory electrically connects with an input end of the digital-to-analog converter; and a digital-to-analog converter, wherein an output end of the digital-to-analog converter electrically correspondingly connects with the source of the second TFT in each of the pixel internal driving circuits.

Furthermore, the first TFT, the second TFT, the third TFT, and the fourth TFT are low temperature polysilicon TFTs, oxide semiconductor TFTs, or amorphous silicon TFTs.

Furthermore, the writing signals and the scan signals are provided by an external timing controller.

Furthermore, the writing signals, the scan signals, and the data signals cooperate with each other and correspond to a detecting stage, and the detecting stage includes a first stage, a second stage, and a third stage. In the first stage, the writing signals are at low electric potential, the scan signals are at high electric potential, the data signals are at high electric potential, and the second TFT, the third TFT, and the fourth TFT are turned on. In the second stage, the writing signals are at low electric potential, the scan signals are at high electric potential, the data signals are at high potential, the second TFT and the third TFT are turned off, and the Vref disconnects from the sensing line. In the third stage, the writing signals are at low electric potential, the scan signals are at high electric potential, and the data signals are at high potential.

Furthermore, the pixel mixed compensation circuit of claim 5, wherein the writing signals, the scan signals, and the data signals cooperate with each other, and a driving luminescent stage is performed after the detecting stage. In the driving luminescent stage, the writing signals are at high electric potential, the scan signals are at low electric potential, and the data signals are at high electric potential.

Furthermore, the scan signals have a higher electric potential than an electric potential of the writing signals, and the scan signals have a higher electric potential than an electric potential of the data signals.

The present disclosure provides a mixed pixel compensation method, including following steps: providing the above pixel mixed compensation circuit; performing a first stage of a detecting stage, wherein in the first stage, the writing signals are at low electric potential, the scan signals are at high electric potential, the data signals are at high electric potential, the second TFT, the third TFT, and the fourth TFT are turned on, the data signals and the Vref respectively write initial electric potentials into the first node and the second node; performing a second stage of the detecting stage, wherein in the second stage, the writing signals are at low electric potential, the scan signals are at high electric potential, the data signals are at high potential, the second TFT and the third TFT are turned off, the Vref disconnects from the sensing line, the VDD starts to charge the second node, an electric potential of the first node increases because the first capacitor is coupled, the Vgs remains unchanged, and an electric potential of the sensing line increases because the second capacitor is coupled; and performing a third stage of the detecting stage, wherein in the third stage, the writing signals are at low electric potential, the scan signals are at high electric potential, the data signals are at high potential, the first switch is turned on, and the external compensation circuit detects the Vgs and provides compensate voltage for the pixel internal driving circuits.

Furthermore, the pixel mixed compensation method includes: in the third stage, detecting an electric potential of the sensing line at different gray levels in different pixels at time t, and recording an initial value Vs0; and repeating the detecting stage, and detecting an electric potential Vsi of the sensing line at time tin each of the stages until the electric potential Vsi is equal to the initial value Vs0, wherein i represents a number of repeating time of the detecting stage, and if the electric potential Vsi and the initial value Vs0 are different, the external compensation circuit starts to provide compensate voltage for the pixel internal driving circuits.

Furthermore, the pixel mixed compensation method includes: entering a driving luminescent stage, wherein in the driving luminescent stage, the writing signals are at high electric potential, the scan signals are at low electric potential, and the data signals are at high electric potential.

Regarding the beneficial effects: the present disclosure provides a pixel mixed compensation circuit and a pixel mixed compensation method. A fourth TFT and a second capacitor are disposed between a source of a third TFT and a drain of a third TFT. The fourth TFT is turned on only during a detecting stage, and is turned off during a lighting process to prevent fourth TFTs in different rows from interfering with each other. The second capacitor is configured to feed back changes in electric potential of a second node to a sensing line. An external compensation circuit can detect the changes in electric potential, which are changes in current resulting from drifts of a threshold voltage (Vth) and mobility, of the second node by the sensing line. The external compensation circuit can directly react to changes in current and can transmit a voltage value, which is to be set, to a first node via data signals to adjust a voltage of the first node. Therefore, a Vgs of a first TFT remains unchanged because of a compensation voltage.

DESCRIPTION SPECIFIC EMBODIMENTS OF THE INVENTION

Embodiments are further described below in detail with reference to accompanying drawings to make objectives, technical solutions, and effects of the present disclosure clearer and more precise. It should be noted that described embodiments are merely used to construct the present disclosure and are not intended to limit the present disclosure.

Figure 1:
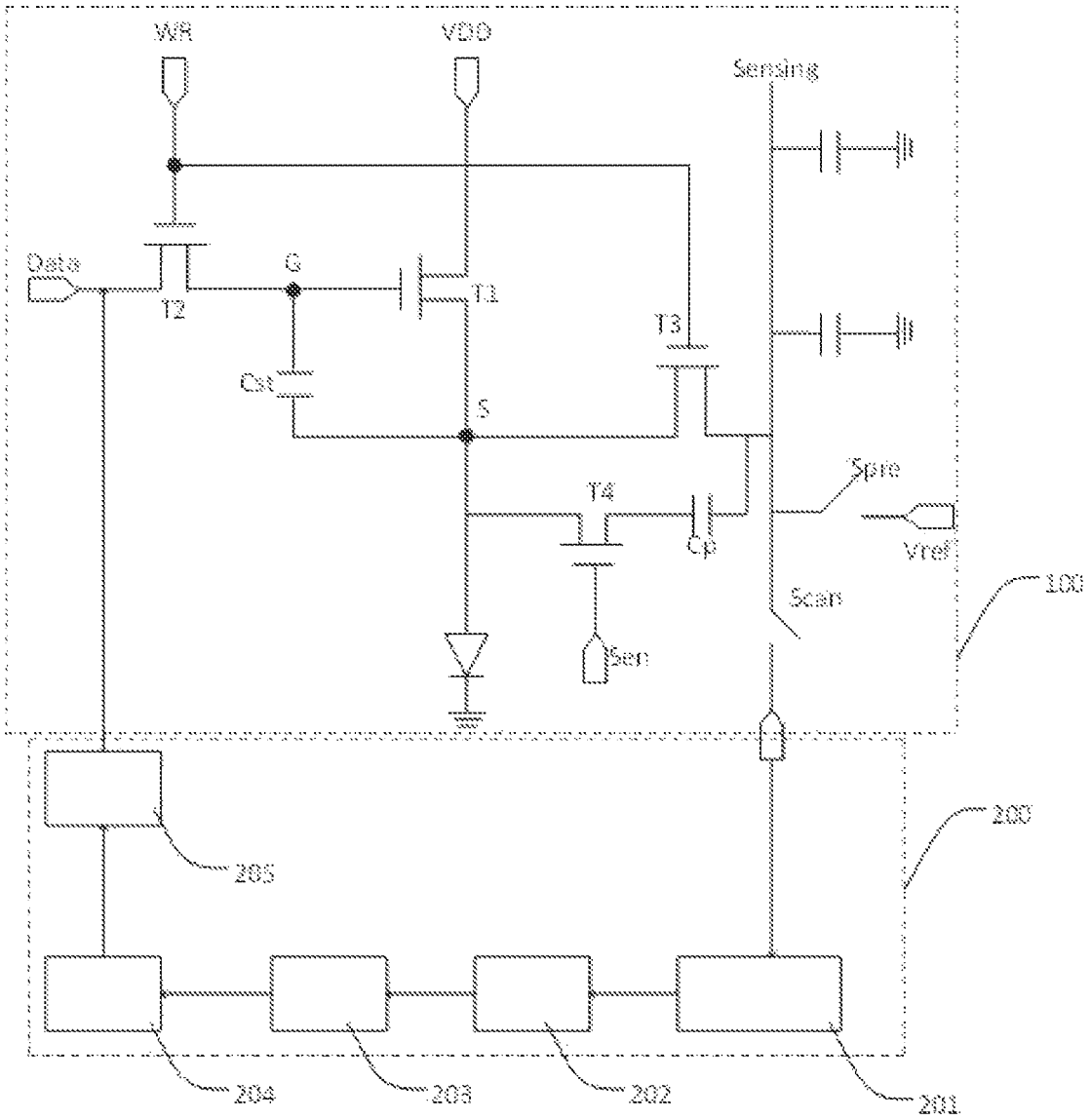
FIG. 1 is a circuit diagram showing a pixel mixed compensation circuit provided by the present disclosure.

As shown in FIG. 1, the present disclosure provides a pixel mixed compensation circuit 100, including a plurality of internal driving circuits of pixels arranged in an array and an external compensation circuit 200 connecting with each of the pixel internal driving circuits by a first switch (Scan).

Each of the pixel internal driving circuits includes a first TFT (T1), a second TFT (T2), a third TFT (T3), a fourth TFT (T4), a first capacitor (Cst), and an organic light-emitting diode (D1).

A gate of the first TFT (T1) electrically connects with a first node (G), a source of the first TFT (T1) electrically connects with a second node (S), and a drain of the first TFT (T1) receives a power supply voltage (VDD).

A gate of the second TFT (T2) receives a plurality of writing signals (WR), a source of the second TFT (T2) receives a plurality of data signals (Data), and a drain of the second TFT (T2) electrically connects with the first node (G);

A gate of the third TFT (T3) receives the writing signals (WR), a source of the third TFT (T3) electrically connects with the first node (G), and a drain of the third TFT (T3) electrically connects with a sensing line (Sensing).

The fourth TFT (T4) receives a plurality of scan signals (Sen), a source of the fourth TFT (T4) electrically connects with a second capacitor (Cp), and a drain of the fourth TFT (T4) electrically connects with the second node (S). The fourth TFT (T4) is turned on only during a detecting stage, and is turned off during a lighting process to prevent fourth TFTs (T4) in different rows from interfering with each other. The second capacitor (Cp) is configured to feed back changes in electric potential of a second node (S) to the sensing line (Sensing).

An end the first capacitor (Cst) electrically connects with the first node (G), and another end of the first capacitor (Cst) electrically connects with the second node (S);

An end of the second capacitor (Cp) electrically connects with the sensing line (Sensing).

An anode of the OLED electrically connects with the second node (S), and a cathode of the OLED connects with ground.

The sensing line (Sensing) electrically connects to a plurality of parasitic capacitances connecting with ground and parallelly connecting with each other, and the sensing line (Sensing) electrically receives a reference voltage (Vref) by a second switch (Spre).

The external compensation circuit 200 is configured to detect whether standard voltages (Vgs) of the first node (G)

and the second node (S) are equal to the VDD, if not, the external compensation circuit 200 calibrates the data signals (Data) transmitted into a pixel circuit according to a difference between the Vgs and the VDD, and then transmits calibrated data signals (Data) into the pixel circuit.

The first TFT (T1), the second TFT (T2), the third TFT (T3), and the fourth TFT (T4) are low temperature polysilicon TFTs, oxide semiconductor TFTs, or amorphous silicon TFTs.

The external compensation circuit 200 includes an analog-to-digital converter 201, a voltage comparator 202, a control module 203, a memory 204, and a digital-to-analog converter 205.

An input end of the analog-to-digital converter 201 electrically connects with the corresponding sensing line (Sensing) in each of the pixel internal driving circuits, and an output end of the analog-to-digital converter electrically connects to an input end of the voltage comparator.

An output end of the voltage comparator 202 electrically connects with an input end of the control module 203.

An output end of the control module 203 electrically connects to an input end of the memory 204.

An input end of the memory 204 electrically connects with an input end of the digital-to-analog converter 205.

An output end of the digital-to-analog converter 205 electrically connects with the corresponding source of the second TFT (T2) in each of the pixel internal driving circuits.

The writing signals (WR) and the scan signals (Sen) are provided by an external timing controller.

Figure 2:
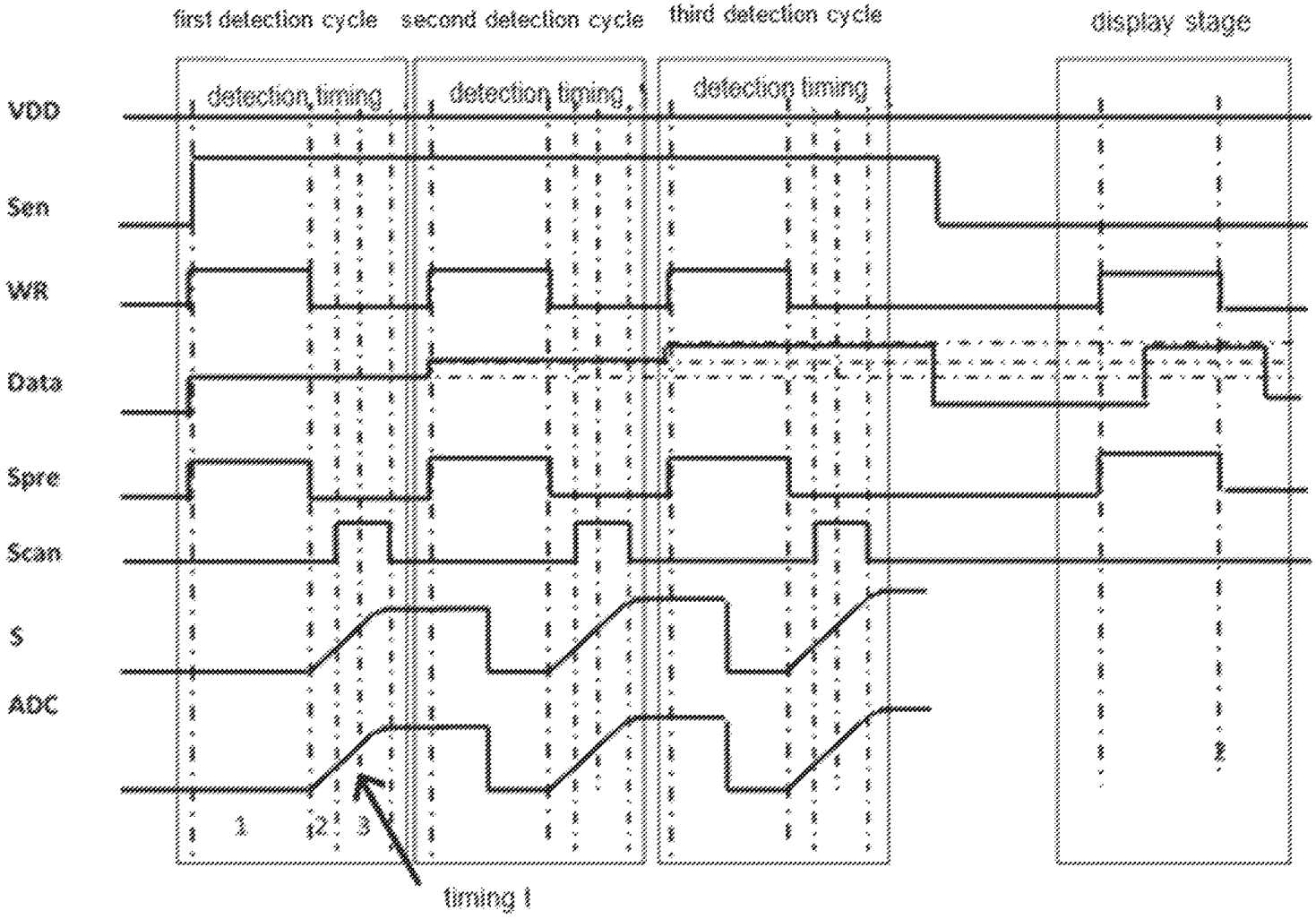
FIG. 2 is a timing diagram showing the pixel mixed compensation circuit provided by the present disclosure.

As shown in FIG. 2, the writing signals (WR), the scan signals (Sen), and the data signals (Data) cooperate with each other and correspond to a detecting stage, and the detecting stage includes a first stage 1, a second stage 2, and a third stage 3.

In the first stage 1, the writing signals (WR) are at low electric potential, the scan signals (Sen) are at high electric potential, the data signals (Data) are at high electric potential, and the second TFT (T2), the third TFT (T3), and the fourth TFT (T4) are turned on.

In the second stage 2, the writing signals (WR) are at low electric potential, the scan signals (Sen) are at high electric potential, the data signals (Data) are at high potential, the second TFT (T2) and the third TFT (T3) are turned off, and the TFT disconnects from the sensing line (Sensing).

In the third stage 3, the writing signals (WR) are at low electric potential, the scan signals, (Sen) are at high electric potential, and the data signals (Data) are at high potential.

The writing signals (WR), the scan signals (Sen), and the data signals (Data) cooperate with each other, and a driving luminescent stage is performed after the detecting stage.

In the driving luminescent stage, the writing signals (WR) are at high electric potential, the scan signals (Sen) are at low electric potential, and the data signals (Data) are at high electric potential.

The scan signals (Sen) have a higher electric potential than an electric potential of the writing signals (WR).

The scan signals (Sen) have a higher electric potential than an electric potential of the data signals (Data).

The present disclosure further provides a pixel mixed compensation method, including following steps:

Step 1: providing the above pixel mixed compensation circuit 100.

Step 2: performing a first stage 1 of a detecting stage, wherein in the first stage 1, the writing signals (WR) are at low electric potential, the scan signals (Sen) are at high electric potential, the data signals (Data) are at high electric potential, the second TET (T2), the third TFT (13), and the fourth TFT (14) are turned on, and the data signals (Data) and the Vref respectively write initial electric potentials into the first node (G) and the second node (S).

Step 3: performing a second stage 2 of the detecting stage, wherein in the second stage 2, the writing signals (WR) are at low electric potential, the scan signals (Sen) are at high electric potential, the data signals (Data) are at high potential, the second TFT (T2) and the third TFT (T3) are turned off, the Vref disconnects from the sensing line (Sensing), the VDD starts to charge the second node (5), an electric potential of the first node (G) increases because the first capacitor (Cst) is coupled, the Vgs remains unchanged, and an electric potential of the sensing line (Sensing) increases because the second capacitor (Cp) is coupled.

Step 4: performing a third stage 3 of the detecting stage, wherein in the third stage 3, the writing signals (WR) are at low electric potential, the scan signals (Sen) are at high electric potential, the data signals (Data) are at high potential, the first switch (Scan) is turned on, and the external compensation circuit 200 detects the Vgs and provides compensating voltage for the pixel internal driving circuits.

Detecting an electric potential on the sensing line (Sensing) at a time before an electric potential on the second code is saturated, wherein by assuming that $\delta t$ is a time difference between the above time and a shut-off time of the writing signals (WR), V0 is a voltage that is detected, and Vgs remains unchanged during $\delta t$ (a current flowing through the first TFT (T1) is I0 and remain unchanged), a charging principle of a capacitor: $t*I0=(V0-Vref)*C$ can be referred. For a stable panel, C is constant, (V0−Vref) is proportional to I0 if C remains unchanged, and V0 is proportional to I0 when Vref=0. Therefore, changes in I0 can be directly reacted to by detecting changes in V0.

In the third stage 3, an electric potential on the sensing line (Sensing) at different gray levels is detected in different pixels at time t, and an initial value Vs0 is recorded.

Step 5: repeating the detecting stage, and detecting an electric potential Vsi on the sensing line (Sensing) at time t in each of the stages until the electric potential Vsi is equal to the initial value Vs0, wherein i represents a number of repeating times of the detecting stage, and if the electric potential Vsi and the initial value Vs0 are different, the external compensation circuit 200 starts to provide compensating voltage for the pixel internal driving circuits.

If a detecting value Vsi is equal to the initial value Vs0, we can infer that an electrical property of a TFT and a voltage of an anode of an OLED have not drifted, a current remains unchanged when a same voltage is applied to the TFT and the anode of the OLED, and a voltage of the data signals (Data) remains unchanged.

When the detecting value Vsi is not equal to the initial value Vs0, the voltage of the data signals (Data) is adjusted according to a minimum step size of the data signals (Data). The voltage of the data signals (Data) is adjusted according to the detecting steps of the detecting stage until the detecting value Vsi is equal to the initial value Vs0, and a voltage (Vdata) is recorded after compensation (as shown in FIG. 2, a voltage of the data signals (Data) is adjusted two times, that is, the first node (G) is compensated, thereby stabilizing the entire Vgs). During a process of adjusting the Vdata, if the initial value Vs0 cannot be completely equal to the detecting value Vsi, the closest value is taken as the Vdata.

The present method can complete detection and compensation of TFT electrical drift in one go, and can simultaneously provide compensating voltage for the TFT. Because detecting process can be finished in a very short period of time, both the detecting process and the compensating process can be performed when a panel is shut down or being used.

During the detecting process, a sum of the second capacitor (Cp) and parasitic capacitances on the sensing line is assumed to be C.

Step 6: entering a driving luminescent stage, wherein in the driving luminescent stage, the writing signals (WR) are at high electric potential, the scan signals (Sen) are at low electric potential, and the data signals (Data) are at high electric potential.

An embodiment shows electrical parameters in the pixel internal driving circuit of the above embodiment based on both the pixel mixed compensation method provided by the present disclosure and FIG. 2.

TABLE 1 electrical parameters in different TFTs

| δVth(V) | mobility | VADC (V) | Vdata (V) | loled (nA) before compensation | loled (nA) after compensation | a change in current before compensation | a change in current after compensation |
|---|---|---|---|---|---|---|---|
| 0 | U0 | 5.813 | 5 | 378.42 | | | |
| 1.5 | U0 | 5.818 | 6.576 | 52.67 | 380.5 | 75.56% | 0.27% |
| −1.5 | U0 | 5.817 | 3.48 | 994.2 | 375.4 | 44.86% | 0.40% |
| 0 | 1.5 * U0 | 5.819 | 4.66 | 523.74 | 393.2 | 16.11% | 1.92% |
| 0 | 0.5 * U0 | 5.819 | 5.833 | 208 | 372.45 | 29.06% | 0.80% |
| 1.5 | 1.5 * U0 | 5.814 | 6.206 | 73.7 | 385.43 | 67.40% | 0.92% |
| −1.5 | 0.5 * U0 | 5.813 | 4.295 | 559.8 | 379.16 | 19.33% | 0.10% |

According to the timing as shown in FIG. 2, a voltage of data signals (Data) that are needed to be compensated and an amount of current before/after the compensation in different TFTs and in different mobilities are detected. A voltage (Vth) of TFTs is equal to voltages (Vgs) of the first node (G) and the second node (S) as shown in FIG. 1.

Assuming that an initial mobility of a TFT is U0 and a voltage of the data lines is 5V, an electric potential VADC on the sensing line (Sensing) is 5.813V at time t. Then, detecting an electric potential on the sensing line (Sensing) according to the steps of the pixel mixed compensation method until a detecting voltage is equal to an initial voltage. Finally, recording the electric potential on the sensing line (Sensing), which is a voltage of data signals (Data) after compensation.

According to results of currents, it can be seen that when only Vth changes (±1.5V), percentage changes in currents are greater than 44% without compensation, while percentage changes in currents are less than 0.5% with compensation. When only mobility changes (0.5 times or 1.5 times of its original value), percentage changes in currents are greater than 16% without compensation, while percentage changes in current are less than 2% with compensation.

The present disclosure provides a pixel mixed compensation circuit 100 and a pixel mixed compensation method. A fourth TFT (T4) and a second capacitor (Cp) are disposed between a source of a third TFT (T3) and a drain of a third TFT (T3). The fourth TFT (T4) is turned on only during a detecting stage, and is turned off during a lighting process to prevent fourth TFTs (T4) in different rows from interfering with each other. The second capacitor (Cp) is configured to feed back changes in electric potential of a second node (S) to a sensing line (Sensing). An external compensation circuit 200 can detect the changes in electric potential, which are changes in current resulting from drifts of a threshold voltage (Vth) and mobility, of the second node (S) by the sensing line. The external compensation circuit 200 can directly react to changes in current and can transmit a voltage value, which is to be set, to a first node (G) via data signals (Data) to adjust a voltage of the first node (G). Therefore, a Vgs of a first TFT (T1) remains unchanged because of a compensation voltage.

In summary, many changes and modifications to the described embodiment can be carried out by those skilled in the art, and all such changes and modifications are intended to be included within the scope of the appended claims.

What is claimed is:

1. A pixel mixed compensation circuit, comprising a plurality of internal driving circuits of pixels arranged in an array and an external compensation circuit connecting with each of the pixel internal driving circuits by a first switch;

wherein each of the pixel internal driving circuits comprises:

a first thin film transistor (TFT), wherein a gate of the first TFT electrically connects with a first node, a source of the first TFT electrically connects with a second node, and a drain of the first TFT receives a power supply voltage (VDD);

a second TFT, wherein a gate of the second TFT receives a plurality of writing signals, a source of the second TFT receives a plurality of data signals, and a drain of the second TFT electrically connects with the first node;

a third TFT, wherein a gate of the third TFT receives the writing signals, a source of the third TFT electrically connects with the second node, and a drain of the third TFT electrically connects with a sensing line;

a fourth TFT, wherein the fourth TFT receives a plurality of scan signals, a source of the fourth TFT electrically connects with a second capacitor, and a drain of the fourth TFT electrically connects with the second node;

a first capacitor, wherein an end the first capacitor electrically connects with the first node, and another end of the first capacitor electrically connects with the second node;

the second capacitor, wherein an end of the second capacitor electrically connects with the sensing line; and an organic light-emitting diode (OLED), wherein an anode of the OLED electrically connects with the second node, and a cathode of the OLED connects with ground;

wherein the sensing line electrically connects to a plurality of parasitic capacitances connecting with ground and parallelly connecting with each other, and the sensing line electrically receives a reference voltage (Vref) by a second switch; and the external compensation circuit is configured to detect whether standard voltages (Vgs) of the first node and the second node are equal to the VDD, if not, the external compensation circuit calibrates the data signals transmitted into a pixel circuit according to a difference between the Vgs and the VDD, and then transmits calibrated data signals into the pixel circuit.

2. The pixel mixed compensation circuit of claim 1, wherein the external compensation circuit comprises an analog-to-digital converter, a voltage comparator, a control module, a memory, and a digital-to-analog converter;

an input end of the analog-to-digital converter electrically connects with a corresponding sensing line in each of the pixel internal driving circuits, and an output end of the analog-to-digital converter electrically connects to an input end of the voltage comparator;

an output end of the voltage comparator electrically connects with an input end of the control module;

an output end of the control module electrically connects to an input end of the memory;

an input end of the memory electrically connects with an input end of the digital-to-analog converter; and an output end of the digital-to-analog converter electrically connects with a corresponding source of the second TFT in each of the pixel internal driving circuits.

3. The pixel mixed compensation circuit of claim 2, wherein the writing signals, the scan signals, and the data signals cooperate with each other and correspond to a detecting stage, and the detecting stage comprises a first stage, a second stage, and a third stage;

in the first stage, the writing signals are at high electric potential, the scan signals are at high electric potential, the data signals are at high electric potential, and the second TFT, the third TFT, and the fourth TFT are turned on;

in the second stage, the writing signals are at low electric potential, the scan signals are at high electric potential, the data signals are at high potential, the second TFT and the third TFT are turned off, and the Vref disconnects from the sensing line; and in the third stage, the writing signals are at low electric potential, the scan signals are at high electric potential, and the data signals are at high potential.

4. The pixel mixed compensation circuit of claim 3, wherein the writing signals, the scan signals, and the data signals cooperate with each other, and a driving luminescent stage is further performed after the detecting stage; and in the driving luminescent stage, the writing signals are at high electric potential, the scan signals are at low electric potential, and the data signals are at high electric potential.

5. The pixel mixed compensation circuit of claim 3, wherein the scan signals have a higher electric potential than an electric potential of the writing signals; and the scan signals have a higher electric potential than an electric potential of the data signals.

6. The pixel mixed compensation circuit of claim 1, wherein the first TFT, the second TFT, the third TFT, and the fourth TFT are low temperature polysilicon TFTs, oxide semiconductor TFTs, or amorphous silicon TFTs.

7. The pixel mixed compensation circuit of claim 1, wherein the writing signals and the scan signals are provided by an external timing controller.

8. A mixed pixel compensation method, comprising following steps:

providing a pixel mixed compensation circuit, wherein the pixel mixed compensation circuit comprises a plurality of pixel internal driving circuits arranged in an array and an external compensation circuit connecting with each of the pixel internal driving circuits by a first switch;

each of the pixel internal driving circuits comprises:

a first thin film transistor (TFT), wherein a gate of the first TFT electrically connects with a first node, a source of the first TFT electrically connects with a second node, and a drain of the first TFT receives a power supply voltage (VDD);

a second TFT, wherein a gate of the second TFT receives a plurality of writing signals, a source of the second TFT receives a plurality of data signals, and a drain of the second TFT electrically connects with the first node;

a third TFT, wherein a gate of the third TFT receives the writing signals, a source of the third TFT electrically connects with the second node, and a drain of the third TFT electrically connects to a sensing line;

a fourth TFT, wherein the fourth TFT receives a plurality of scan signals, a source of the fourth TFT electrically connects with a second capacitor, and a drain of the fourth TFT electrically connects with the second node;

a first capacitor, wherein an end the first capacitor electrically connects with the first node, and another end of the first capacitor electrically connects with the second node;

the second capacitor, wherein an end of the second capacitor electrically connects with the sensing line; and an organic light-emitting diode (OLED), wherein an anode of the OLED electrically connects with the second node, and a cathode of the OLED connects with ground;

wherein the sensing line electrically connects with a plurality of parasitic capacitances connecting with ground and parallelly connecting with each other, and the sensing line electrically receives a reference voltage (Vref) by a second switch; and the external compensation circuit is configured to detect whether standard voltages (Vgs) of the first node and the second node are equal to the VDD, if not, the external compensation circuit calibrates the data signals transmitted into a pixel circuit according to a difference between the Vgs and the VDD, and then transmits calibrated data signals into the pixel circuit;

performing a first stage of a detecting stage, wherein in the first stage, the writing signals are at high electric potential, the scan signals are at high electric potential, the data signals are at high electric potential, the second TFT, the third TFT, and the fourth TFT are turned on, and the data signals and the Vref respectively write initial electric potentials into the first node and the second node;

performing a second stage of the detecting stage, wherein in the second stage, the writing signals are at low electric potential, the scan signals are at high electric potential, the data signals are at high potential, the second TFT and the third TFT are turned off, the Vref disconnects from the sensing line, the VDD starts to charge the second node, an electric potential of the first node increases because the first capacitor is coupled, the Vgs remains unchanged, and an electric potential of the sensing line increases because the second capacitor is coupled; and performing a third stage of the detecting stage, wherein in the third stage, the writing signals are at low electric potential, the scan signals are at high electric potential, the data signals are at high potential, the first switch is turned on, and the external compensation circuit detects the Vgs and provides compensating voltage for the pixel internal driving circuits.

9. The pixel mixed compensation method of claim 8, wherein the pixel mixed compensation method further comprises:

in the third stage, detecting an electric potential of the sensing line at different gray levels in different pixels at time t, and recording an initial value Vs0;

repeating the detecting stage, and detecting an electric potential Vsi of the sensing line at time t in each of the stages until the electric potential Vsi is equal to the initial value Vs0, wherein i represents a number of repeating times of the detecting stage, and if the electric potential Vsi and the initial value Vs0 are different, the external compensation circuit starts to provide compensating voltage for the pixel internal driving circuits.

10. The pixel mixed compensation method of claim 9, wherein the pixel mixed compensation method comprises:

entering a driving luminescent stage, wherein in the driving luminescent stage, the writing signals are at high electric potential, the scan signals are at low electric potential, and the data signals are at high electric potential.

* * * * *